US005125573A

United States Patent [19]

Vanotti

[11] Patent Number: 5,125,573

[45] Date of Patent: Jun. 30, 1992

[54] DEVICE FOR FIXING A RAILROAD RAIL ON A TIE

[75] Inventor: Gérard Vanotti, Saint-Paul-De-Varax, France

[73] Assignee: Etablissements VAPE, Saint-Martin-Du-Fresne, France

[21] Appl. No.: 694,676

[22] Filed: May 2, 1991

[30] Foreign Application Priority Data

May 2, 1990 [FR] France ..... 90 05537

[51] Int. Cl.[5] ..... E01B 9/30

[52] U.S. Cl. ..... 238/351; 238/338

[58] Field of Search ..... 238/338, 340, 341, 342, 238/343, 344, 351, 354

[56] References Cited

U.S. PATENT DOCUMENTS

| | | | |
|---|---|---|---|
| 3,206,123 | 9/1965 | Baker | 238/351 X |
| 3,870,231 | 3/1975 | Toyama | 238/354 X |
| 4,066,212 | 1/1978 | Sonneville | 238/351 X |
| 4,109,860 | 8/1978 | Serafin et al. | 238/351 X |
| 4,111,361 | 9/1978 | Sonneville | 238/338 |
| 4,274,582 | 6/1981 | Fee | 238/338 X |
| 4,353,503 | 10/1982 | Duchemin | 238/338 X |
| 4,447,006 | 5/1984 | Matsuo | 238/351 X |

FOREIGN PATENT DOCUMENTS

| | | | |
|---|---|---|---|
| 1046648 | 3/1955 | Fed. Rep. of Germany | 238/351 |
| 1111832 | 3/1956 | France | 238/351 |
| 967694 | 8/1964 | United Kingdom | 238/351 |
| 1003755 | 9/1965 | United Kingdom | 238/351 |
| 1003756 | 9/1965 | United Kingdom | 238/351 |
| 2086966 | 5/1982 | United Kingdom | 238/338 |

*Primary Examiner*—Robert J. Spar
*Assistant Examiner*—Robert S. Katz
*Attorney, Agent, or Firm*—Kane, Dalsimer, Sullivan, Kurucz, Levy, Eisele and Richard

[57] ABSTRACT

Device for fixing a rail on a tie, comprising an abutment made of plastic material and a clamp made of steel fixed by a rail screw or a nut. The clamp is provided with an oblong hole which makes it possible to displace the clamp in a direction perpendicular to the rail, in such a way that the clamp can occupy a preparation position, in which the rail can be placed vertically between two abutments, and a fixing position, in which the clamp bears against the flange of the rail. This device makes it possible to pre-equip ties in workshops.

4 Claims, 2 Drawing Sheets

DEVICE FOR FIXING A RAILROAD RAIL ON A TIE

FIELD OF THE INVENTION

The subject of the present invention is a device for fixing a railroad rail on a tie, comprising an abutment made of synthetic material which is intended to hold the rail in position laterally and has, on the side opposite the rail, a profile in the form of a downwardly-directed undulation which is intended to engage in a groove which has a mating profile and is provided in the tie parallel to the rail, a groove which extends above the undulation, parallel to the latter, and a vertical hole for the passage of a rail screw or of a bolt or a threaded rod, provided with a nut, an elastic metal clamp in the form of a curved polygonal plate which has a hole for the passage of the rail screw or of the bolt respectively, and a heel in the form of an undulation of a shape mating with that of said groove of the abutment.

PRIOR ART

From the patient FR 2 426 770, a device for fixing a railroad rail is known, the clamp of which is constituted by a steel plate which is curved in a direction parallel to the rail and provided with a heel in the form of an undulation which engages in a groove of corresponding shape of an abutment made of synthetic material.

It is furthermore known from the patent FR 2 553 122 to provide a groove in a tie made of concrete for the support of the abutment and of the clamp.

Rail fixing devices which comprise a clamp constituted by a curved steel plate are moreover described in numerous patents.

For rational and rapid working, it would be advantageous to have available on site ties which are pre-equipped with their devices for fixing rails. The advantage of such pre-equipment is, however, greatly reduced with the known devices because the rail screw or the nut of the bolt has to be removed and the clamp drawn back for it to be possible to put the rail in place, these handling operations removing all advantage of a pre-equipment of the ties.

SUMMARY OF THE INVENTION

The aim of the invention is to provide a fixing device which makes it possible to pre-equip a tie in such a way that the rail can be placed vertically on the tie between its abutments and that, by means of a simple and rapid handling operation, the clamp can be brought over the flange of the rail and then tightened on this flange.

To this end, the fixing device according to the invention is characterised in that the clamp is curved in a direction perpendicular to the rail and that the hole of the clamp is oblong in a direction perpendicular to the rail, in such a way that the clamp can occupy two stable positions on its abutment, namely a preparation position, in which its undulating heel bears against the abutment outside the groove of the abutment and its opposite edge does not extend beyond the edge of the abutment on the rail side, and a fixing position, in which its heel is engaged in the groove of the abutment and its opposite edge is above the flange of the rail.

The clamp is held in the preparation position by slight tightening of the rail screw, or of the nut of the bolt respectively. After the rail has been put in place, it is only necessary to loosen the rail screw, or the nut respectively, and to push the clamp by its heel in the direction of the rail. The undulating heel of the clamp naturally comes to engage in the groove of the abutment and it is then only necessary to tighten the rail screw, or the nut respectively.

So as to secure well the preparation position of the clamp, that edge of the abutment opposite the rail is advantageously provided with a concave oblique face, in which the undulating heel of the clamp comes to rest.

In order to avoid the wearing of the flange of the rail by rubbing of the clamp, the edge of the clamp bearing against the flange of the rail is advantageously provided with a cover made of synthetic material which moreover has an effect of electrical insulation.

BRIEF DESCRIPTION OF THE DRAWINGS

The attached drawing represents, by way of example, an embodiment of the invention.

DESCRIPTION OF THE PREFERRED EMBODIMENT

Figure 1:
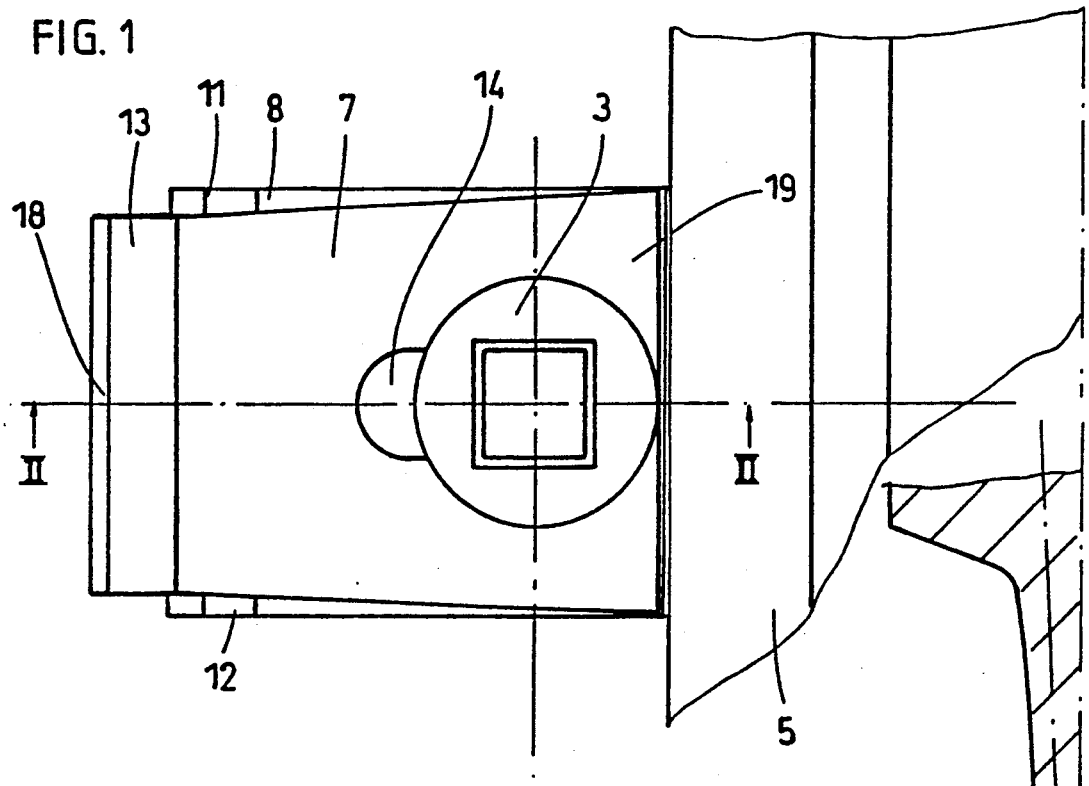
FIG. 1 is a view from above of the fixing device in the preparation position.

FIGS. 1 to 4 represent partially a tie made of concrete 1, in which a sleeve 2 made of synthetic material is embedded, which is surrounded by a metal envelope and provided with a thread (not shown). Such a sleeve is described and represented, for example, in the documents FR 2 425 014 and 2 566 017. This sleeve 2 is intended to receive a rail screw 3. The tie 1 has transverse grooves 4 which extend parallel to the direction of the rails. The presence of these grooves 4 does not make it impossible to make the tie 1 from prestressed concrete.

The tie 1 is intended to support rails, one of which is partially represented by 5, with interposition of a rubber baseplate-pad 6. The rails 5 are held in position by fixing devices which are each constituted by a rail screw 3, by a steel clamp 7 and by an abutment 8 made of synthetic material.

On the side opposite the rail 5, the abutment 8 has a heel 9 in the form of an undulation of a shape mating with the shape of the groove 4 of the tie so as to fit perfectly in the groove 4. On its upper face, the heel 9 has a groove 10 in the form of an undulation which has an axis parallel to that of the groove 4 and is delimited axially by two stops 11 and 12, the distance separating these stops being very slightly greater than the width of the left end of the clamp 7. Seen in a plan view, the clamp 7 has a part in the form of a trapezium which is prolonged towards the left by a rectangular part which forms a heel 13 in the form of an undulation of a shape mating with the shape of the groove 10 of the abutment. The clamp 7 is moreover curved in a direction perpendicular to the rail 5 with a downwardly-directed concavity. It has an oblong hole 14 which has a width slightly greater than the diameter of the rail screw 3 and extends in a direction perpendicular to the rail.

The abutment 8 is provided with a vertical cylindrical hole 15 for the passage of the rail screw and it has a plane support surface 16 around this hole 15, this support surface 16 being connected to the groove 10 by an inclined plane 17. That edge of the abutment 8 opposite the rail 5 is inclined and has a concave cylindrical face 18, the axis of which is parallel to the axis of the groove 10.

Figure 2:
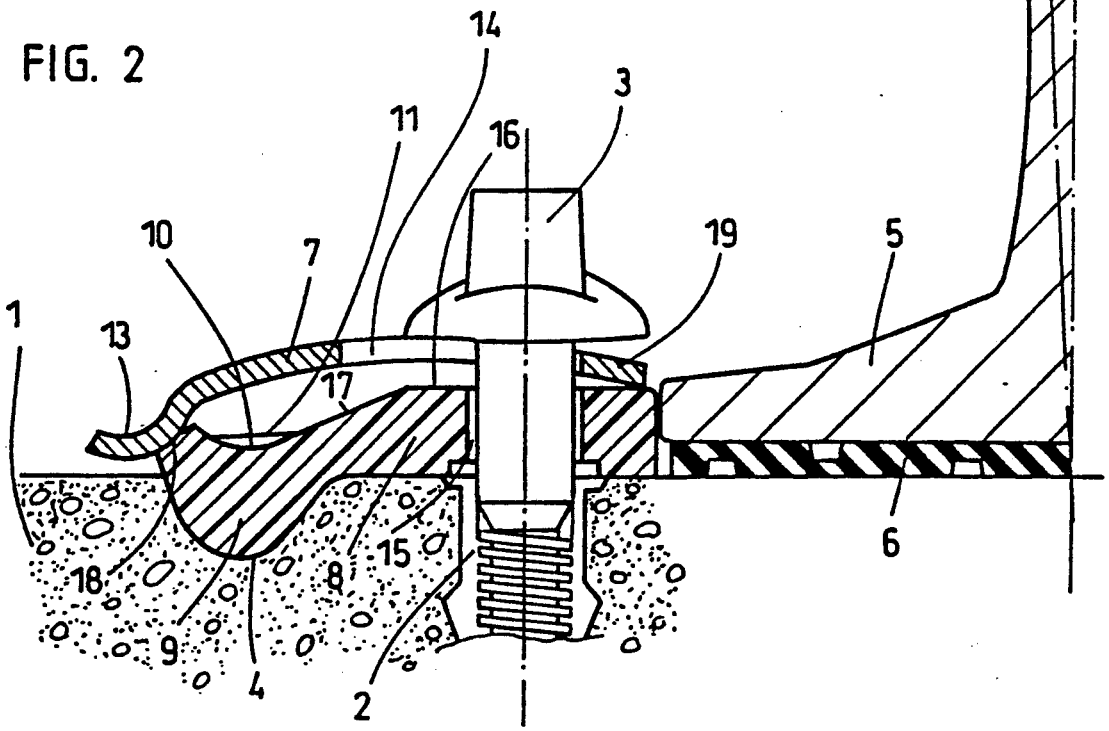
FIG. 2 is a view in cross-section according to II—II in FIG. 1.
Figure 3:
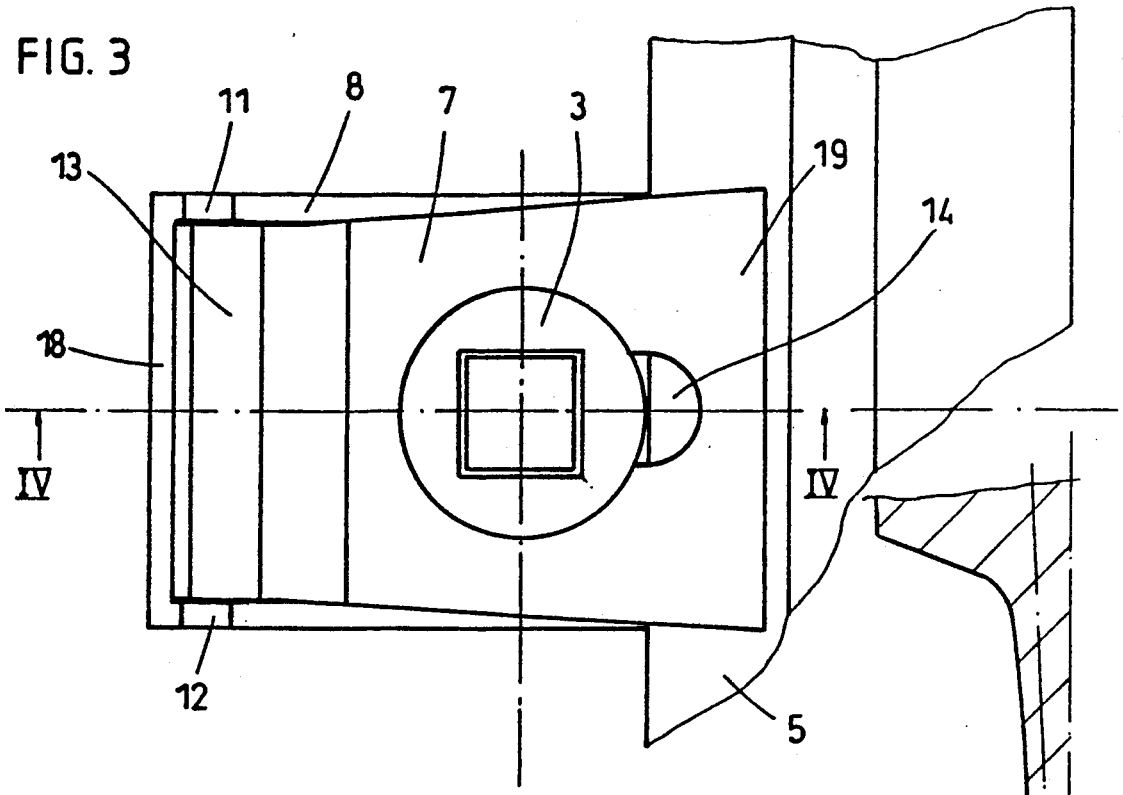
FIG. 3 is a plan view of the device in the fixing position.
Figure 4:
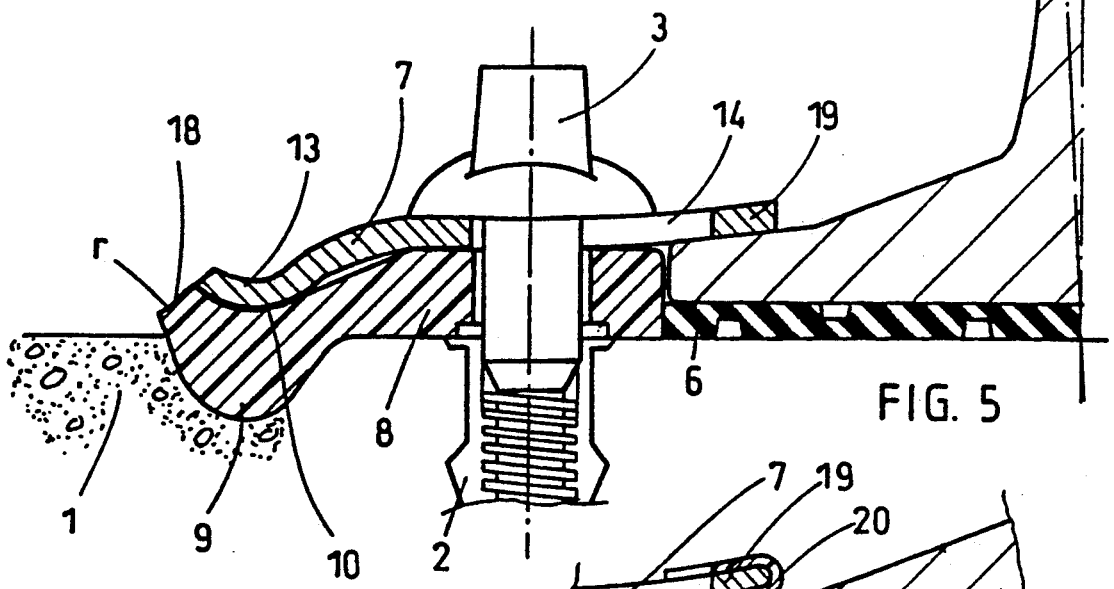
FIG. 4 is a view in cross-section according to IV—IV in FIG. 3.

The tie is provided in the workshop as represented in FIGS. 1 and 2, but without the rail 5 and its baseplate-pad 6. In this preparation position, the undulating heel 13 of the clamp 7 bears against the concave face 18 of the abutment 8 and the inner edge 19 of the clamp bears against the abutment 8, set back from the corresponding edge of the abutment. The clamp 7 is held in this preparation position, with slight tension, by the rail screw 3.

The tie 1, intended to receive two rails, is of course provided with three other abutments 8, each rail being arranged between two abutments in well-known manner.

On site, the tie having been put in place, the rail 5 is set down vertically between its two abutments. The rail screw 3 is then loosened slightly so as to afford the clamp 7 sufficient liberty and the latter is pushed in the direction of the rail 5. The heel 13 of the clamp 7 comes to engage of itself in the groove 10 of the abutment. The displacement is moreoever limited by the length of the oblong hole 14. The inner edge 19 of the clamp 7 comes to position itself on the flange of the rail 5. It is then only necessary to tighten the rail screw 3 in order to flatten the clamp 7, the elastic deformation of the latter ensuring excellent fixing of the rail. Since the heel 13 of the clamp 7 is engaged in the groove 10 of the abutment between the stops 11 and 12, it is prevented from turning under the effect of the rail screw.

An eventual demounting of the rail can also be carried out easily by partially loosening the rail screw 3 and by drawing the clamp 7 backwards.

Figure 5:
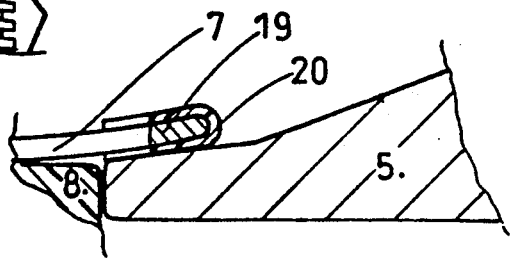
FIG. 5 represents the detail of a modification of FIG. 4.

If it is desired to avoid the contact of metal on metal between the clamp 7 and the rail 5, in order to reduce the wearing of the rail by rubbing, it is possible to provide the edge 19 of the clamp with a cover 20 made of synthetic material as represented in FIG. 5. This cover 20 has a U-shaped profile and it is closed at its sides.

The rail screw can be replaced by a bolt with a nut. The fixing device can be used with ties made of different materials such as concrete, metal, wood, plastic or composite material.

I claim:

1. A device for affixing a railroad rail having a flange on a tie having at least one downardly-directed groove orientated parallel to the ral, said device comprising:

an abutment made of synthetic material having a vertical hole for the passage of screw means, a first side, and a second side opposite said first side, said first side restrains said rail flange from lateral movement, said second side having a lower profile to substantially match and mate with said downwardly-directed groove, an upper profile in the shape of a concave groove orientated parallel to said downwardly-directed groove, and an edge supporting surface located adjacent said concave groove and farther from said rail; and an elastic metal clamp in the form of a curved polygonal plate which is curved in a direction perpendicular to the longitudinal direction of said rail, said clamp having a first side, a second side opposite said first side, said second side having a heel with a lower profile to substantially match and mate with said concave groove, and a vertical hole which is elongated in a direction perpendicular to the longitudinal direction of said rail for the passage of said screw means and said elongated hole having a first end proximal to said rail and a second end distal from said rail, said clamp being movable with respect to said abutment and said screw means in a direction perpendicular to said longitudinal direction of said rail between a first stable preparatory position wherein said heel bears against the edge supporting surface of said abutment, said first side of said clamp does not extend beyond the edge of the first side of the abutment, and said screw means is adjacent said first end of said elongated hole, and a second stable fixing position wherein said heel is engaged in said concave groove, said first side of said clamp does extend beyond the edge of the first side of the abutment and is above the flange of said rail, and said screw means is adjacent said second end of said elongated hole.

2. The fixing device as claimed in claim 1, wherein said edge supporting surface of said abutment has a concave cylindrical oblique face on which said heel of said clamp bears upon in said preparatory position.

3. The fixing device as claimed in claim 1, wherein said concave groove of said abutment is delimited at its ends so as to form two lateral stops for the heel of the clamp when said clamp is in said fixing position, so as to restrain said clamp from movement in a direction parallel to the longitudinal direction of said rail.

4. The fixing device as claimed in claim, wherein said first side of said clamp that extend beyond the edge of the first side of the abutment in said fixing position is provided with a cover made of synthetic material.

* * * * *